United States Patent [19]

Way et al.

[11] 3,962,897

[45] June 15, 1976

[54] METAL WORKING APPARATUS AND METHODS OF PIERCING

[75] Inventors: Lewis A. Way; Robert C. Williams, both of Columbiana, Ohio

[73] Assignee: Columbiana Foundry Company, Columbiana, Ohio

[22] Filed: May 11, 1970

[21] Appl. No.: 36,406

Related U.S. Application Data

[62] Division of Ser. No. 493,234, Oct. 5, 1965, abandoned.

[52] U.S. Cl. ..... 72/209; 72/370; 75/122; 75/171

[51] Int. Cl.[2] ..... B21B 17/10

[58] Field of Search ..... 72/67, 209, 368, 370; 75/122, 126, 128, 134, 170, 171; 148/32

[56] References Cited

UNITED STATES PATENTS

| | | | |
|---|---|---|---|
| 1,903,952 | 4/1933 | Wissler | 75/171 |
| 2,126,750 | 8/1938 | De Golyer | 75/171 |
| 2,197,098 | 4/1940 | Davis et al. | 75/128 |
| 2,263,020 | 11/1941 | Trantin | 75/128 |
| 2,799,003 | 7/1957 | Nowak | 75/171 |
| 3,237,441 | 3/1966 | Eberle | 72/209 |

OTHER PUBLICATIONS

P. 846, The Making, Shaping and Treating of Steel (1964).

P. 1388, Van Nostrand's Scientific Encyclopedia (1947).

*Primary Examiner*—Lowell A. Larson
*Assistant Examiner*—E. M. Combs
*Attorney, Agent, or Firm*—Buell, Blenko & Ziesenheim

[57] ABSTRACT

A method and apparatus are provided for piercing metal members at high temperatures, particularly members containing slag inclusions, by the steps of urging said member, over a piercer point by rolling whereby said point passes through and forms an axial opening in the ingot, said point being formed of an alloy comprising 0.015% to 2% Carbon, about 5% to 65% Cobalt, about 15% to 35% Chromium and up to about 30% iron.

4 Claims, No Drawings

METAL WORKING APPARATUS AND METHODS OF PIERCING

This application is a division of our copending application Ser. No. 493,234, filed Oct. 5, 1965 now abandoned.

This invention relates to apparatus and methods of piercing metal at high temperature in contact with flowing metal surfaces.

The manufacture of seamless tube and pipe using piercer points, pipe plugs and reeler plugs is well known. Typically in a high mill a red hot tube is rolled over a stationary plug to reduce the wall thickness of the tube. The tube is pulled over the plug by means of two rolls grooved to the outside diameter of the tube. In a normal mill practice the wall is reduced in two passes with the tube being rotated 90° between passes.

The hollow tube above mentioned is formed by feeding a heated billet over a piercer point between rolls which force the billet over the piercer point while forming the outer periphery of the pipe. Typically this operation is carried out on a Mannesmann piercing mill having two double conical rolls, each set at an angle to the work piece. A billet at about 1750° to 2300°F. is fed into the mill until engaged by the rolls which start it spinning. Since the rolls are set at an angle to the path of the billet, one component of force is in the longitudinal direction which pulls the billet forward onto the piercing point. The metal then flows along both sides of the piercer point forming a tube. After each billet is formed the piercer point is quenched in water. Thus the piercer point operates under extreme conditons of thermal shock, compression, wear, impact, longitudinal and torsional stress. Piercer points have in the past been generally made of an alloy of iron containing 0.2% carbon, 2% chromium and 2.5% nickel whereas high mill plugs have in the past been generally made of high carbon nickel chromium steels such as 1.75% carbon, 18% chromium, 6% nickel. Such plugs and points are cast, ground to size and scaled at 1750° to 2000°F. This scaling of the point or plug was essential to effective performance of the plug or point and provided a surface carburization protective scale without which the point or plug did not operate successfully. Such plugs and points had a relatively short work life at best and were rapidly rendered useless in the presence of slag inclusions in the steel. As a consequence it has been the practice to crop a large section from the head of each ingot to reduce the possibility of slag inclusions and the consequent reduction in the life of plugs and points. This is obviously economically undesirable.

We have discovered an apparatus and method of piercing metal using a piercer point, high mill plug, reeler plug or like member which does not need to be scaled before use, which has vastly increased service or work life and which is not adversely affected by the presence of slag in the metal being worked. Preferably such members are made of a composition relatively low in iron but high in cobalt. Compositions for use in such members lie in the broad range as follows:

| | | | | |
|---|---|---|---|---|
| C | — | 0.015% | — | 2% |
| Co | — | 5% | — | 65% |
| Cr | — | 15% | — | 35% |
| Fe | — | 0% | — | 30% |

In the foregoing composition we have found that cobalt is absolutely essential and that the carbon must be reduced as the iron content increases. We have also found that boron, molybdenum, tungsten, titanium, nickel, copper, vanadium, aluminum and tantalum and columbium may be present for imparting the qualities generally associated with such elements without detrimentaly affecting the alloy. In the case of piercer points we prefer to use lower carbon contents, below 0.5%, whereas in the case of high mill plugs we prefer the higher range of the foregoing analysis, above 0.5% carbon.

Preferably, we maintain the analysis within a narrower range of composition for maximum hot hardness and resistance to erosion and deterioration as well as maximum surface qualities such as resistance to slag or oxide accretion. Such narrower range of composition is:

| | | | | |
|---|---|---|---|---|
| C | — | 0.03% | — | 1.5% |
| Co | — | 40% | — | 65% |
| Cr | — | 15% | — | 28% |
| Fe | — | 0% | — | 12% |

Again various amounts of other alloy constituents as mentioned above may be present.

The subject matter of this invention may perhaps best be understood by reference to the following examples.

EXAMPLE I

Three 5 ⅛ inch high mill plugs were cast from the composition:

| C | Si | B | Mn | Ni | Co | Cr | Mo | Fe |
|---|---|---|---|---|---|---|---|---|
| 0.61% | 1.15% | 0.01% | 0.77% | 2.6% | 60.1% | 26.8% | 5.47% | 2.4% |

These plugs were used four times and reground for a fifth use. The recapitulation of usage is as follows:

Table I

| | | |
|---|---|---|
| 1st mill run | No. 1 plug | 50 shells for 2⅝" tubing |
| | No. 2 plug | 118 shells for 5½" tubing |
| | No. 3 plug | 179 shells for 5½" tubing |
| 2nd mill run ground to 5 1/16" | No. 1 plug | (not used) |
| | No. 2 plug | 149 shells for 5½" tubing |
| | No. 3 plug | 182 shells for 5½" tubing |
| 3rd mill run | No. 1 plug | (ground to 5 1/16") 444 shells for 5½" tubing |
| | No. 2 plug | (ground to 5") 360 shells for 5½" tubing |
| | No. 3 plug | (ground to 5") 349 shells for 5½" tubing |
| 4th mill run | No. 1 plug | (ground to 4 15/16") 684 shells for |

Table I-continued

| | | |
|---|---|---|
| | | 5½" tubing |
| | No. 2 plug | (ground to 4⅞") 125 shells for 5½" tubing |
| | No. 3 plug | (ground to 4⅞") 125 shells for 5½ " tubing |
| 5th mill run | No. 1 plug | (ground to 4⅞") (not yet used) |
| | No. 2 plug | (ground to 4 13/16") (not yet used) |
| | No. 3 plug | (ground to 4 13/16") (not yet used) |

Total pieces rolled to date on three plugs is 2765 for an average of 920 pieces per plug and the plugs are still usable. The normal number of pieces on the same mill using a conventional plug of high carbon nickel chromium steel is 66 to 70 pieces per plug. It is apparent that the plugs of this invention are about 15 times better than conventional plugs in pieces per plug produced. The significance of this in time and expense is obvious.

EXAMPLE II

Four high mill plugs 4 11/16 inch in size were cast from the following composition:

| C | Si | Mn | Ni | Co | Cr | Mo | Fe |
|---|---|---|---|---|---|---|---|
| 0.71 | 1.09 | 1.07 | 2.40 | 59.3 | 26.7 | 5.9 | 2.8 |

These plugs were tested in making 4 ½ inch O.D. pipe, wall thickness 0.25 inch, weight per foot 11.6 , of alloy steel range 2 in the usual manner. The pieces rolled per plug in one run are listed in the following table:

Table II

| Plug No. | Pieces Rolled |
|---|---|
| 1 | 282 |
| 2 | 220 |
| 3 | 221 |
| 4 | 190 |

The total pieces rolled in one run was 913 or an average of 228.2 pieces per plug. The plugs were still in good condition and were reground for further use. Here again, the normal production for conventional plugs is about 65 pieces.

EXAMPLE III

Six piercer points were cast from a composition of the following analysis:

| C | Si | Mn | Ni | Co | Cr | W |
|---|---|---|---|---|---|---|
| 0.06 | 0.19 | 0.95 | 10.2 | 49.5 | 18.8 | 17.85 |

These points were solution annealed and aged at 1400°F. for 8 hours. These points average 366 billets on poor quality (slag inclusions) steel whereas standard points lasted an average of 1.4 billets. This illustrates the ability of the steel of this invention to stand up in the presence of slag which heretofore has been destructive of piercer points.

EXAMPLE IV

Eight piercer points 3¾ inch diameter were cast of material having the following analysis:

| C | Mn | Si | B | Cr | Ni | Co | Mo | Fe |
|---|---|---|---|---|---|---|---|---|
| 0.10 | 0.52 | 0.84 | 0.006 | 26.60 | 2.8 | 61.35 | 5.9 | 1.41 |

and air cooled. These points were used in a Mannesmann piercing mill using an air quench to pierce billets of a coarse grain open top casing heat of steel of the following analysis:

| C | Mn | Si | P | S |
|---|---|---|---|---|
| .43/.48 | 1.00/1.20 | 0.25 max. | 0.040 max. | 0.060 max. |

These points pierced a total of 2200 billets for an average of 275 passes per point. Standard points on the same material ran 455 points for 3699 billets or 8.1 passes per point.

EXAMPLE V

Four points of the analysis of Example IV were used in the same mill but water quenched. The four points produced 875 billets pierced for an average of 219 passes per point as compared with the 8.1 passes of the conventional points.

EXAMPLE VI

Eight piercer points were cast of an alloy of the composition:

| C | Si | Mn | Ni | Co | Cr | Mo | B |
|---|---|---|---|---|---|---|---|
| 0.03 | 0.80 | 0.79 | 2.7 | 61.2 | 27.5 | 5.65 | 0.01 |

The points were subject only to normal shake out treatment and used in same mill and on same material as Example IV. The eight points pierced a total of 1957 billets, using an air quench, for an average of 245 passes per point. This compares with 8.1 passes per point of conventional points as pointed out in Example IV.

EXAMPLE VII

Seven piercer points were cast of a material of the composition:

| C | B | Mn | Si | Cr | Ni | Co | W | Fe | Mo |
|---|---|---|---|---|---|---|---|---|---|
| 0.07 | 0.004 | 0.76 | 0.97 | 19.95 | 10.10 | 48.95 | 15.05 | 2.44 | 1.8 |

The points were solution annealed and placed in same mill as Example IV piercing the same material but using a water quench. The seven points pierced 2134 billets for an average of 305 passes per point as compared with 8.1 passes per point of conventional materials.

EXAMPLE VIII

Eight piercer points of the following analysis were cast:

| C | Si | Mn | B | Ni | Co | Cr | Mo |
|---|---|---|---|---|---|---|---|
| 0.03 | 0.80 | 0.83 | 0.006 | 2.80 | 61.35 | 26.8 | 5.90 |

These points were used in the as cast condition to pierce billets on the same mill as Example IV to pierce billets from a different heat from Example IV but cast to the same specification. The points were air cooled and produced 2200 billets for an average of 275 passes per point. As a comparison 41 standard points were used to pierce 75 billets of the same heat for an average of 1.8 passes per point.

EXAMPLE IX

Four points were cast from an alloy having the analysis:

| C | Si | Mn | Ni | Co | Cr | W |
|---|---|---|---|---|---|---|
| 0.06 | 0.19 | 0.95 | 10.2 | 49.5 | 18.8 | 17.88 |

These points were solution annealed and aged at 1450°F. for 8 hours and used in same mill as Example IV to pierce billets from a like heat of steel. The points were used in rotation with water quenching for a total of 1486 passes for an average of 366 passes per point. As was pointed out in Example IV conventional points were useful for an average of only 8.1 passes.

EXAMPLE X

Seven points were cast from an alloy whose composition was:

| C | Si | Mn | Cr | Ni | Mo | W | Co | B |
|---|---|---|---|---|---|---|---|---|
| 0.07 | 0.97 | 0.76 | 19.95 | 9 | 1.8 | 15.05 | 48.95 | 0.004 |

These points were solution annealed and used in same mill as Example IV on a like heat of steel. The seven points pierced a total of 2490 pieces for an average of 356 passes per point. The points were still usable at the end of the run. Standard point life was less than 2 passes per point.

EXAMPLE XI

Four piercer plugs were prepared (2⅞ inch) from the following composition:

| C | Mn | Si | Ni | Co | Ti | Mo | B |
|---|---|---|---|---|---|---|---|
| 0.02 | 0.06 | 0.13 | 16.9 | 10.6 | 0.22 | 4.61 | 0.0035 |

These plugs were run alongside standard piercer plugs. The plugs of this invention produced an average of 74 tubes per plug and were still usable. The standard plugs were scrapped as not usable at an average of 40 tubes per plug.

From the foregoing examples it will be evident that the method of piercing according to our invention will produce many more pipes than conventional methods using conventional pipe plugs and piercer points and in some cases, as where the metal contains slag, the method of our invention will consistently produce products where the conventional points are unable to be used.

We believe that the peculiar properties of our piercer method and metal working members comes from the formation of a cobalt oxide or cobalt-chromium oxide film under high temperature and pressure which acts as a lubricant. Peculiarly no noticeable film of oxide is formed on heating to high temperatures but a dark film forms on working at the same temperatures, and only on that portion of the tool in contact with the work. The working temperatures of tools according to our invention is about above 1400° at the working surface as compared with about 500°F. for conventional tools. At 1400°F. tools of our invention have a hardness of about 170 DPH while conventional tools are only about 45 DPH. The foregoing theory appears to be supported by the vastly improved and unique results of our invention, but it is at most a theory and we do not wish to be bound by it but rely on the unique result achieved regardless of theory.

While we have illustrated certain preferred embodiments and practices of our invention, it will be understood that this invention may be otherwise practiced within the scope of the following claims.

We claim:

1. A method of piercing metal members, particularly members containing slag inclusions comprising the steps of urging said member at a temperature above about 1750°F over an as formed cast piercer point by rolling whereby said point passes through and forms an axial opening in the ingot, said point being formed of an alloy consisting essentially of about 0.015% to 2% carbon, about 5% to 65% cobalt, about 15% to 35% chromium and about up to 30% iron.

2. A method of piercing metal as claimed in claim 1 wherein the alloy consists essentially of 0.03% to 1.5% carbon, about 40% to 65% cobalt, about 18% to 28% chromium and up to 12% iron.

3. A method of piercing metal as claimed in claim 1 wherein the alloy consists essentially of about 0.6% to 0.8% carbon, about 58% to 62% cobalt, about 18% to 28% chromium and up to 12% iron.

4. In a metal piercing apparatus for piercing elongated metal members at elevated temperatures the combination of at least two spaced apart cooperating rolls and a generally conical piercer point generally between said spaced rolls, said point being composed of an as formed cast alloy, consisting essentially of about 0.015% to 2% carbon, about 5% to 65% cobalt, about 15% to 35% chromium and up to 30% iron.

* * * * *

UNITED STATES PATENT OFFICE

CERTIFICATE OF CORRECTION

Patent No. 3,962,897 Dated June 15, 1976

Inventor(s) Lewis A. Way et al.

It is certified that error appears in the above-identified patent and that said Letters Patent are hereby corrected as shown below:

Column 6, Claim 4, line 54, after "an" delete "as formed cast".

Signed and Sealed this

Tenth Day of May 1977

[SEAL]

*Attest:*

RUTH C. MASON
*Attesting Officer*

C. MARSHALL DANN
*Commissioner of Patents and Trademarks*